US010213899B2

(12) United States Patent
Mangrich et al.

(10) Patent No.: US 10,213,899 B2
(45) Date of Patent: Feb. 26, 2019

(54) FLUID JET CUTTING DEVICE

(71) Applicant: ILLINOIS TOOL WORKS INC., Glenview, IL (US)

(72) Inventors: Benjamin Mangrich, Evanston, IL (US); James A. Haberstroh, Vernon Hills, IL (US); Ahmad Qassab, Roswell, GA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 14 days.

(21) Appl. No.: 15/548,624

(22) PCT Filed: Feb. 29, 2016

(86) PCT No.: PCT/US2016/020082

§ 371 (c)(1),
(2) Date: Aug. 3, 2017

(87) PCT Pub. No.: WO2016/144593

PCT Pub. Date: Sep. 15, 2016

(65) Prior Publication Data

US 2018/0029193 A1 Feb. 1, 2018

Related U.S. Application Data

(60) Provisional application No. 62/130,253, filed on Mar. 9, 2015.

(51) Int. Cl.
*B24C 1/04* (2006.01)
*B24C 3/00* (2006.01)
(Continued)

(52) U.S. Cl.
CPC ..... *B24C 1/045* (2013.01); *B24C 3/00* (2013.01); *B24C 3/06* (2013.01); *B24C 3/32* (2013.01);
(Continued)

(58) Field of Classification Search
CPC .. B24C 1/045; B24C 3/00; B24C 3/06; B24C 3/32; B24C 9/00; B26D 7/02; B26D 3/008
(Continued)

(56) References Cited

U.S. PATENT DOCUMENTS 4,993,199 A * 2/1991 Hughes ..... B24C 9/00 134/104.4
5,143,102 A * 9/1992 Blaul ..... B08B 3/006 134/113
(Continued)

FOREIGN PATENT DOCUMENTS

DE 102009017837 A1 10/2010
EP 0523501 A2 1/1993

*Primary Examiner* — George Nguyen
(74) *Attorney, Agent, or Firm* — Levenfeld Pearlstein, LLC

(57) ABSTRACT

A fluid jet cutting device (10) for sectioning materials is provided. The device includes a compact and portable body (12) having an equipment chamber (14) accessible through a first panel (20), a working chamber (16) accessible through a second panel (22) and a receptacle (18) in communication with the working chamber. A pump assembly (26) and motor (28) are removably positioned on a base (32) in the equipment chamber. A guide assembly (36) is positioned in the working chamber and a cutting head (38) having a nozzle (50) is movably coupled to the guide assembly for movement along three axes. A drive assembly (52) moves the cutting head along the guide assembly. A clamp (56) for holding a work piece includes a first face (58) and a second face (60) movable relative to the first face so as to secure regular, irregular or complex shaped work pieces. A basket (66) is positioned in the receptacle below the clamp and the device may be controlled by way of a touch screen user interface (72).

22 Claims, 11 Drawing Sheets

(51) Int. Cl.

| | |
|---|---|
| ***B24C 3/06*** | (2006.01) |
| ***B24C 3/32*** | (2006.01) |
| ***B24C 9/00*** | (2006.01) |
| ***B26F 3/00*** | (2006.01) |
| ***B26D 7/02*** | (2006.01) |

(52) U.S. Cl.
CPC ..... *B24C 9/00* (2013.01); *B26D 7/02* (2013.01); *B26F 3/004* (2013.01); *B26F 3/008* (2013.01)

(58) Field of Classification Search
USPC ..... 451/89
See application file for complete search history.

(56) References Cited

U.S. PATENT DOCUMENTS 5,295,333 A * 3/1994 Puschner ..... B24C 9/00 451/100
5,460,564 A * 10/1995 Bowes ..... B24C 9/00 312/263
5,836,809 A * 11/1998 Kosic ..... B08B 11/04 451/89
6,280,301 B1 * 8/2001 Rogmark ..... A47L 15/0002 451/447
6,719,612 B2 * 4/2004 Visaisouk ..... B24C 1/003 451/39
7,297,286 B2 * 11/2007 Tannous ..... B08B 5/02 134/1.1
8,668,554 B2 * 3/2014 Hunziker ..... B24C 7/0023 451/102
8,920,210 B2 * 12/2014 Benson ..... B24C 9/006 451/8
9,039,491 B2 * 5/2015 Kobayashi ..... B24C 3/22 451/451
2002/0168924 A1 11/2002 Visaisouk et al.
2002/0182988 A1 * 12/2002 Williams ..... B24C 9/00 451/89
2003/0065424 A1 4/2003 Erichsen et al.
2003/0124955 A1 * 7/2003 Hanson ..... B24C 3/04 451/2
2004/0092216 A1 * 5/2004 Publ ..... B24C 9/00 451/87
2010/0210186 A1 8/2010 Panuska et al.
2010/0211429 A1 8/2010 Benson
2011/0065366 A1 3/2011 Rowe et al.

* cited by examiner

FLUID JET CUTTING DEVICE

CROSS-REFERENCE TO RELATED APPLICATION DATA

This application claims the benefit of and priority to Provisional U.S. Patent Application Ser. No. 62/130,253, filed Mar. 9, 2015, the disclosure of which is incorporated herein in its entirety.

BACKGROUND

The following description relates to fluid jet cutting devices, for example, a fluid jet cutting device for sectioning materials. In one application, the fluid jetting device may be used to section materials for analytical sample preparation.

In a typical fluid jet cutting system, a fluid, such as water, is forced through a nozzle to generate a high-pressure fluid jet having a pressure from 35,000 to 100,000 psi and a velocity of up to three times the speed of sound. The high-pressure fluid jet may be used to cut through, for example, non-metallic materials including rubber, plastic, wood and cloth. A cutting power of the high-pressure fluid jet may be enhanced by adding abrasive particles into the stream to produce an abrasive fluid jet. An abrasive fluid jet may be used to cut, for example, metals including steel, aluminum and titanium, hard non-metals such rock and concrete and other hard materials including armor plate, certain ceramic and tool steel. The abrasive particles are typically garnet, silica and/or aluminum oxide.

The work piece may generally be positioned to lie on a bed of slats above a catcher tank. The slats are typically spaced apart by a distance to allow a sufficient amount of the high-pressure fluid jet to pass therethrough, so that energy from the high-pressure fluid jet may be dissipated by a volume of fluid in the underlying catcher tank. In addition, the high-pressure fluid jet typically cuts the slats, in addition to the work piece, so that the slats are considered consumable and must be replaced on a regular basis.

Control of the cutting head and the nozzle may be manual or preprogrammed. However, for preprogrammed cutting movement of the nozzle, a data or program file typically needs to be imported into the system, for example, from a Computer-Aided Design (CAD) software program. That is, movement of the cutting head or nozzle may not be programmed directly into a user interface of the system to allow for automatic or autonomous movement of the nozzle or cutting head. Accordingly, operation of the system may be difficult for untrained personnel such as those lacking specialized or dedicated training systems or those unfamiliar with CAD software programs.

Fluid jet cutting systems are typically configured for large scale production use, and require complex set-up and programming. A typical fluid jet cutting device may have a footprint of approximately 50 sq. ft. As such, traditional fluid jet cutting systems are not well suited for non-production or operating environments such as laboratories. In addition, because of their size traditional fluid jet cutting systems are not well suited for cutting smaller work pieces, or, a work piece into smaller pieces, for example of widths less than 1 inch. Smaller work pieces or sample pieces may be desirable for use in, for example, metallographic analysis. In addition, the spacing between individual slats of the bed of slats is typically too large for catching or capturing samples from a work piece small enough for use in metallographic analysis.

However, reducing a distance between the slats may negatively impact energy absorption of fluid jet by the fluid in the catcher tank.

Typically, a sample for metallographic analysis is prepared with a metallographic abrasive cutter. An abrasive cutter typically includes a circular abrasive blade spinning along an axis of rotation. The blade will remove a plane of material from a work piece in its path in a direction of rotation. The work piece is typically placed on a bed and clamped using a vise. The bed and/or blade can typically be moved in three axes in order to position the blade with respect to the specimen or work piece. However, this configuration typically requires multiple cuts to be made in order to produce a sufficiently small sample from the work piece at a desired area of interest. In addition, heat or force from the blade may damage the work piece, and in turn, the sample.

Accordingly, it is desirable to provide a fluid jet cutting device suitably sized for use in non-production settings such as a laboratory and for cutting small samples or specimens from a work piece.

SUMMARY

According to one embodiment, there is provided a compact and portable fluid jet cutting device for sectioning materials for analytical sample preparation. The fluid jet cutting device includes a body having an equipment chamber accessible through a first panel, a working chamber accessible through a second panel and a receptacle in communication with the working chamber, a pump assembly positioned in the equipment chamber, and a motor positioned in the equipment chamber, the motor configured to drive the pump assembly. The device further includes a guide assembly positioned in the working chamber, a cutter head assembly having a nozzle for discharging a fluid jet movably coupled to the guide assembly for movement along three axes, and a drive assembly for moving the cutter head along the guide assembly. Further still, the device includes a clamp for holding a work piece in the working chamber, the clamp comprising a first face and a second face movable relative to the first face to secure the work piece therebetween, and a basket positioned in the receptacle beneath the clamp.

The fluid jet cutting device may also include a camera configured to capture an image of the work piece. Further, the fluid jet cutting device may include a user interface including a display. The display may be a touch screen device and the may display the image of the work piece captured by the camera. The clamp is configured to secure complex and/or irregularly shaped work pieces between the first and second faces.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
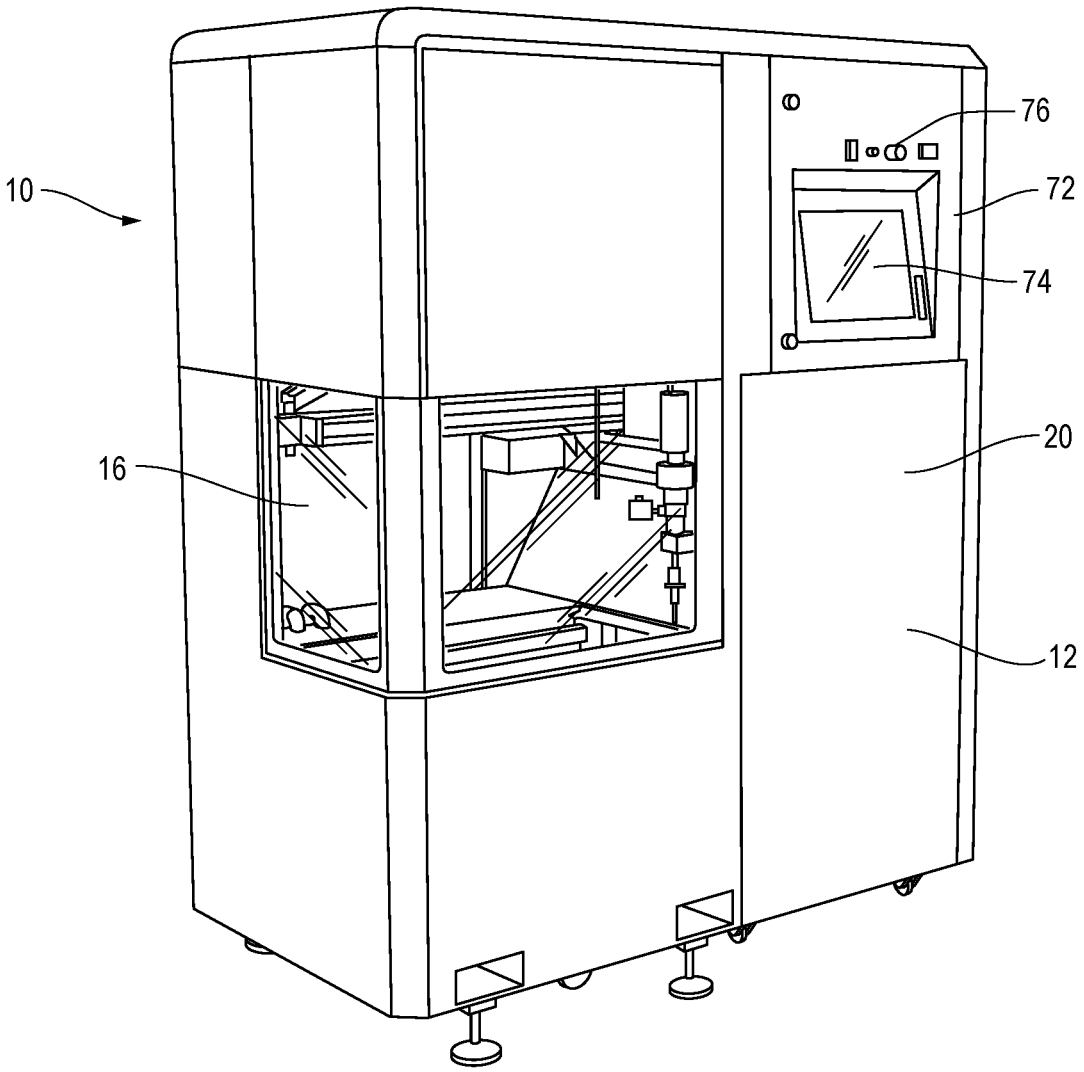
FIG. 1 is a perspective view of a fluid jet cutting device according to an embodiment described herein.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 2:
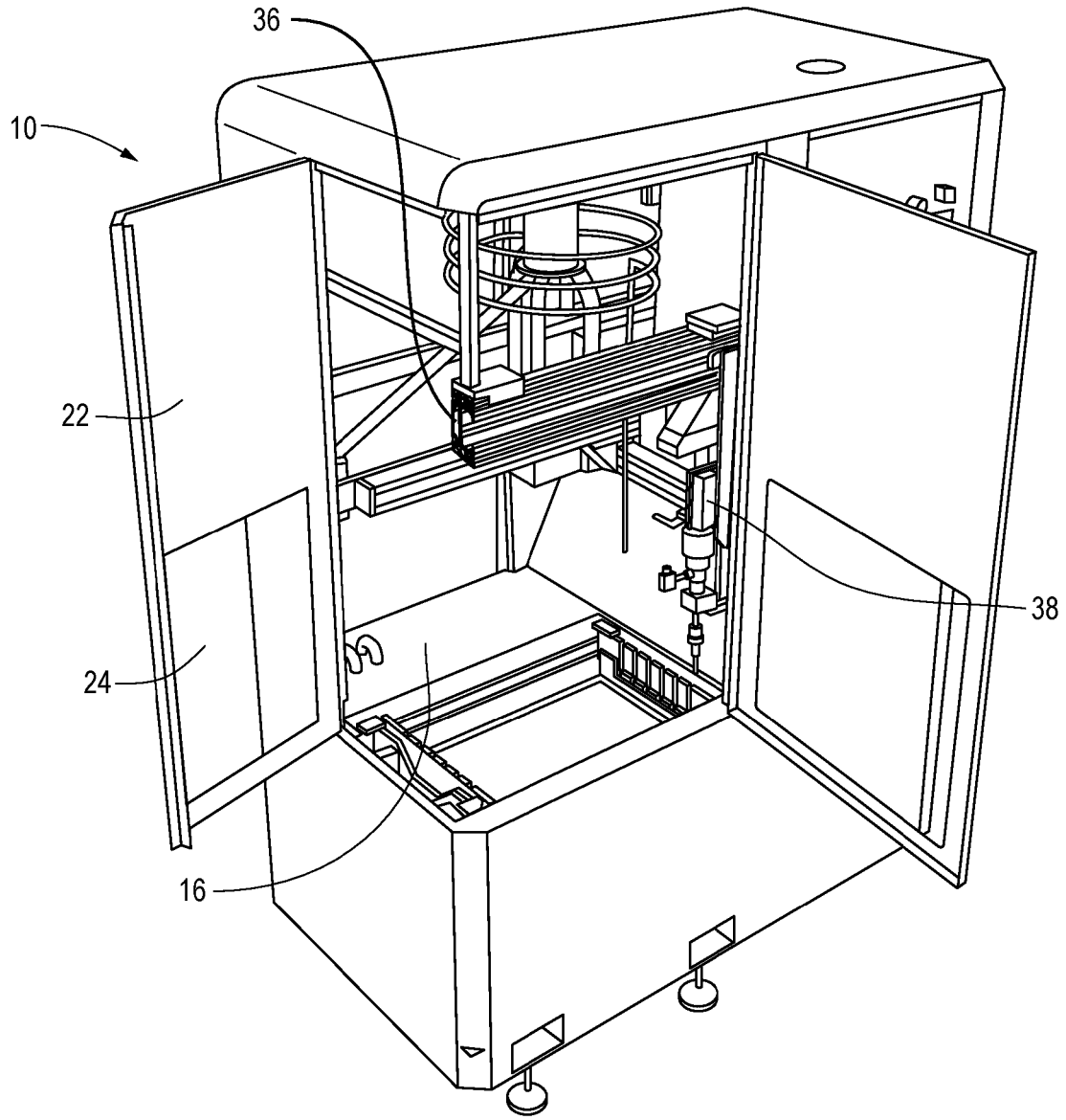
FIG. 2 is a perspective view of the fluid jet cutting device of FIG. 1 in an open condition.
Figure 3:
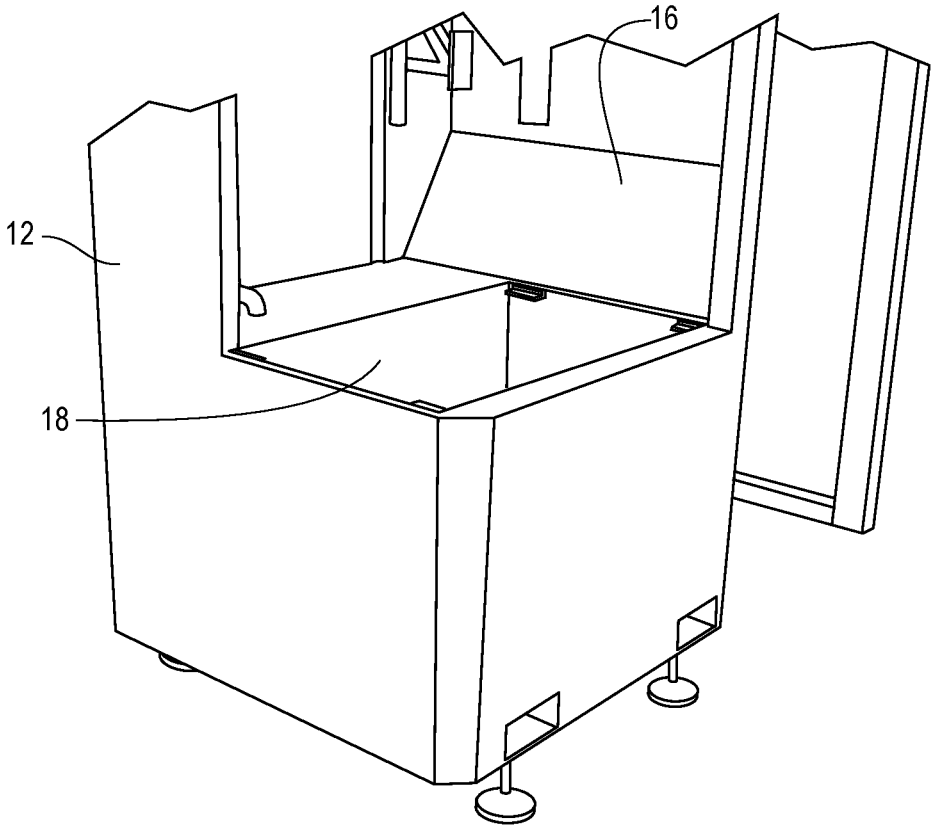
FIG. 3 is a transparent perspective view of a portion of the fluid jet cutting device of FIG. 1 showing interior structures according to an embodiment described herein.

FIG. 1 is a perspective view of a fluid jet cutting device 10 according to an embodiment described herein. FIG. 2 shows the fluid jet cutting device 10 of FIG. 1 in an open condition. FIG. 3 is a transparent perspective view of a portion of the fluid jet cutting device 10 of FIG. 1 to show interior features. The fluid jet cutting device 10 described herein is configured to discharge and direct a high-pressure fluid jet at a work piece to cut the work piece, as described further below. The work piece, in one example, may be a sample from which a specimen may be cut for metallographic analysis. Alternatively, the sample may be cut to desired shape and size for metallographic analysis. In one example, the high-pressure fluid may be water.

Figure 4:
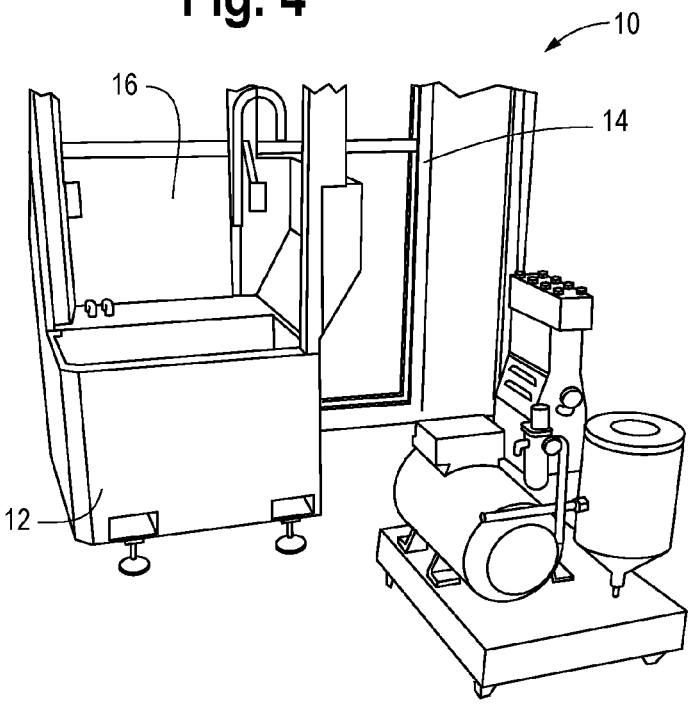
FIG. 4 is a perspective view of the fluid jet cutting device of FIG. 1 in a partially disassembled condition.
Figure 5:
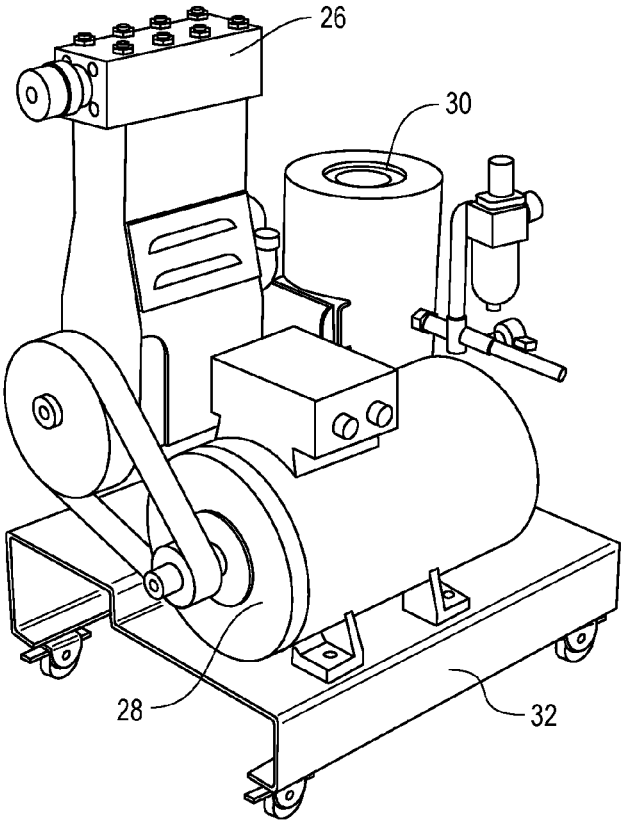
FIG. 5 is perspective view of supply equipment for use in the fluid jet cutting device of FIG. 1, according to an embodiment described herein.

FIG. 4 is a perspective view of the fluid jet cutting device 10 in a partially disassembled condition, according to an embodiment described herein. FIG. 5 is a rear perspective view of equipment which may be removed from the body 12, according to one embodiment. Referring to the examples in FIG. 1-5, in one embodiment, the fluid jet cutting device 10 includes a body 12. The body 12 includes an equipment chamber 14, a working chamber 16 and a receptacle 18 in communication with the working chamber 16. The equipment chamber 14 is configured for housing equipment to power and/or drive the fluid jet cutting device 10 as described further below. The working chamber 16 is a chamber where a work piece or sample (not shown) may be operated on to prepare the specimen. The receptacle 18 is disposed in communication with the working chamber 16. In one embodiment, the receptacle 18 is disposed below the working chamber 16 and is configured to receive fluid from a fluid jet used to cut the work piece as described further below. A volume of fluid may be maintained in the receptacle to dissipate energy from the fluid jet.

The equipment chamber 14 is accessible through one or more first panels 20. In one embodiment one or more first panels 20 may be formed as a pivotable door mounted to the body 12. However, the present disclosure is not limited to this configuration. The one or more first panels 20 may be, alternatively, a removable panel or a sliding panel, for example.

The working chamber 16 is accessible through one or more second panels 22. In one embodiment, the one or more second panels 22 may be formed as one or more doors pivotably mounted to the body 12. Alternatively, the one or more second panels 22 may be removable or slidable panels. In addition, the one or more second panels 22 may include a window 24, formed from, for example, a transparent material such as glass or plastic, including shatter proof or resistant glass, plastic or thermoplastic materials. In one example, the window 24 may be formed from PLEXIGLAS®, but the present disclosure is not limited to this example. The window 24 may allow visual inspection of the working chamber 16.

Referring to FIGS. 4 and 5, the fluid jet cutting device 10 also includes a pump assembly 26 and a motor 28 for driving the pump assembly 26. The fluid jet cutting device 10 may also include an abrasive supply tank 30 for containing a supply of an abrasive material for use in the fluid jet cutting device 10. The abrasive material may be in particle form, and may include, for example, garnet, silica and/or aluminum oxide. In operation, the pump assembly 26, motor 28 and abrasive supply tank 30 may each be positioned in the equipment chamber 14.

With further reference to FIGS. 4 and 5, the pump assembly 26, motor 28 and abrasive supply tank 30 may be removably positioned in the equipment chamber 14. Accordingly, the pump assembly 26, motor 28 and abrasive supply tank 30 may be selectively removed from the equipment chamber 14 for maintenance or replacement, for example. In one embodiment, the fluid jet cutting device 10 further includes a removable base 32. The pump assembly 26, motor 28 and abrasive supply tank 30 maybe mounted to the base 32 so that these components may be removed or installed together simultaneously with the base 32.

Figure 6:
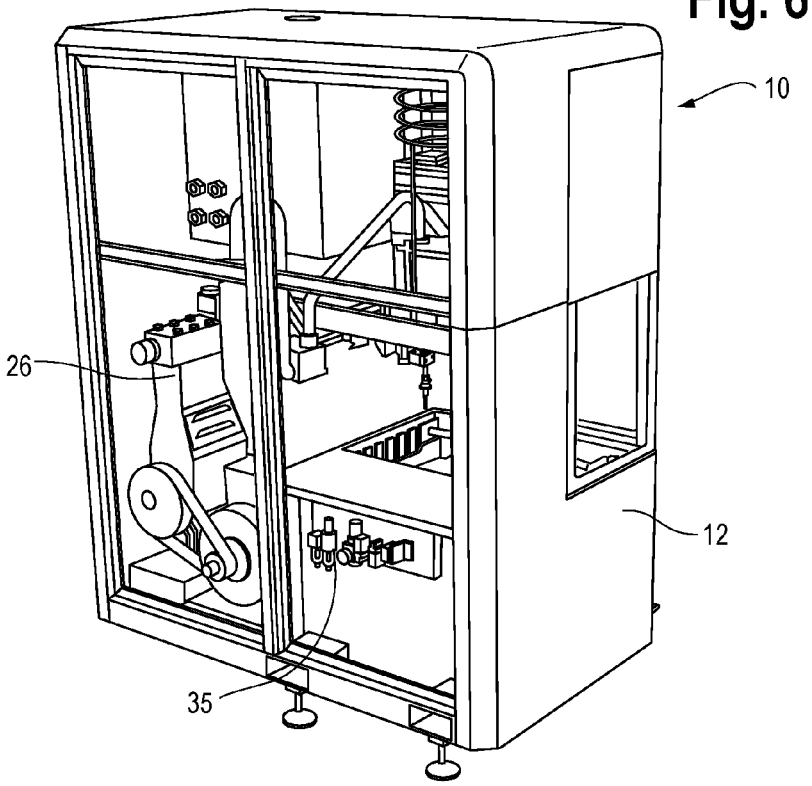
FIG. 6 is a rear view of the fluid jet cutting device of FIG. 1 with rear cover panels removed.
Figure 7:
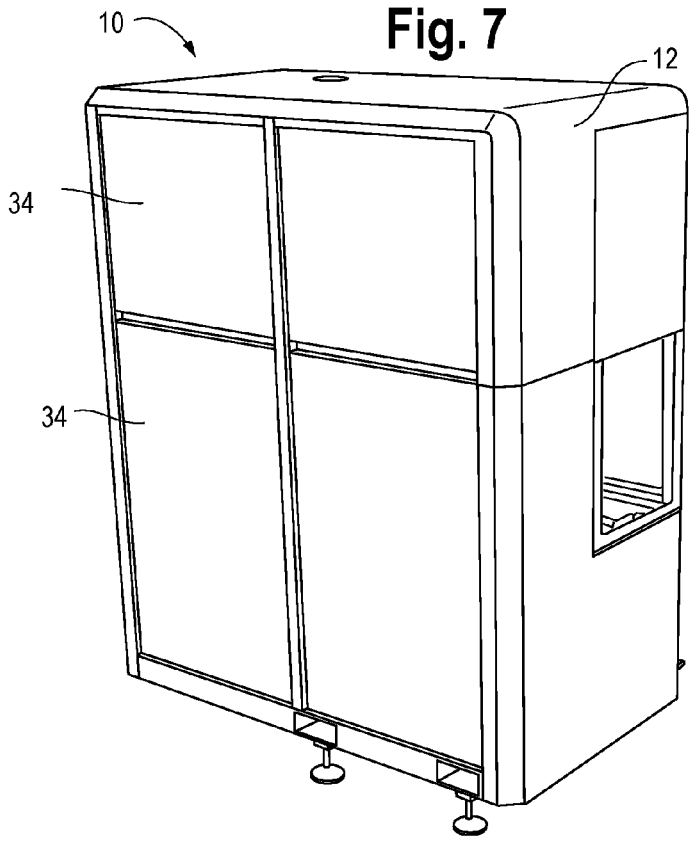
FIG. 7 is a rear view of the fluid jet cutting device of FIG. 1 with rear cover panels installed.

FIGS. 6 and 7 are rear perspective views of the body 12 of the fluid jet cutting device 10 with the rear cover panels 34 removed and installed, respectively, according to an embodiment described herein. Referring to FIGS. 6 and 7, a rear side of the body may be formed with frame work to support one or more rear cover panels 34. In one embodiment, the rear cover panels 34 are removable from the frame work or body 12. However, the present disclosure is not limited to this configuration. For example, the rear cover panels 34 may be formed as one or more pivoting or sliding doors to allow access to the interior of the body 12. Also, as shown in FIG. 6, the device 10 may include mechanical circuitry 35 including fluid and/or pneumatic circuit controls, such as valves, to control a fluid level within the receptacle 18.

Figure 8:
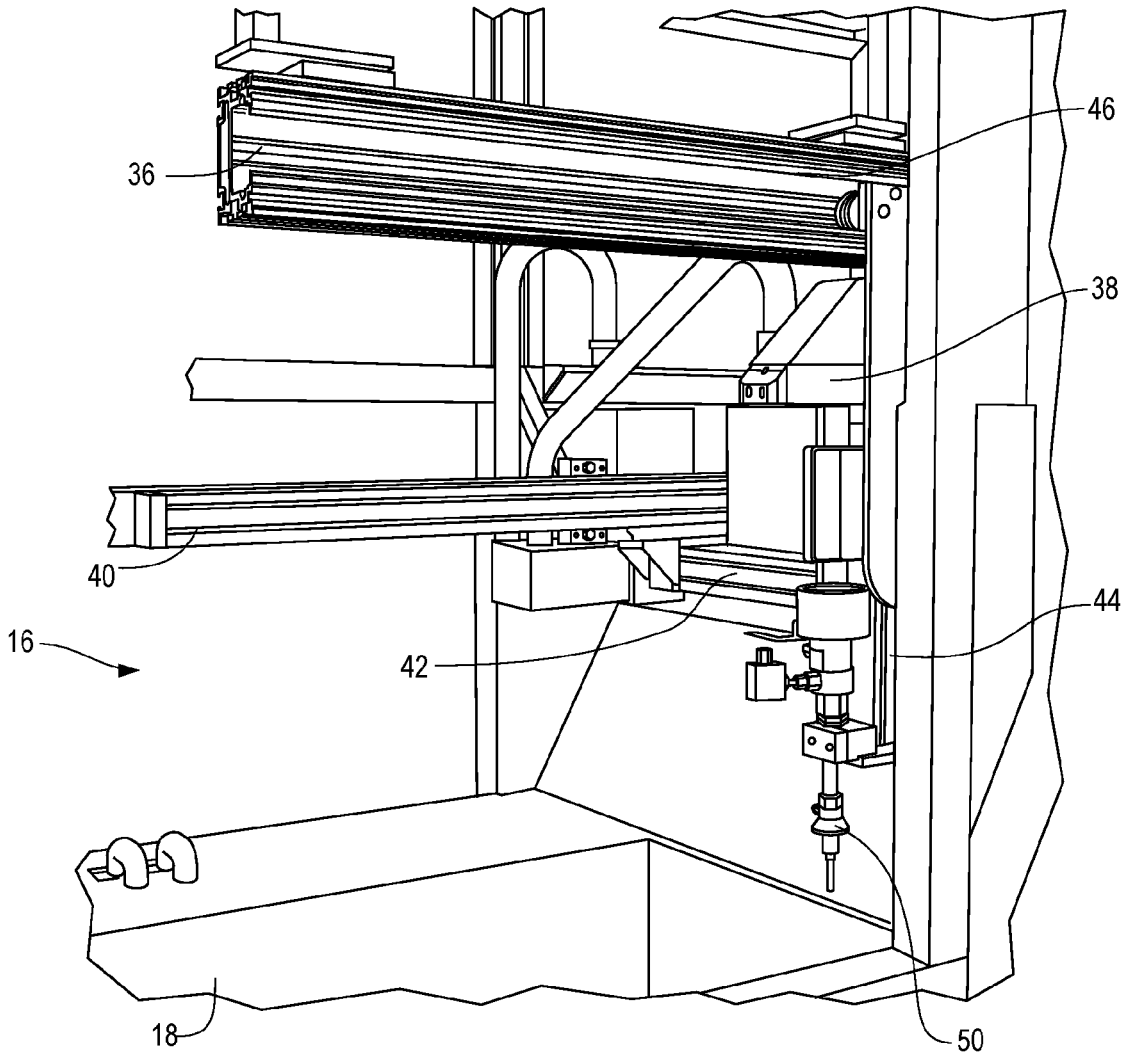
FIG. 8 is a perspective view of a guide assembly in the fluid jet cutting device of FIG. 1, according to an embodiment described herein.
Figure 9:
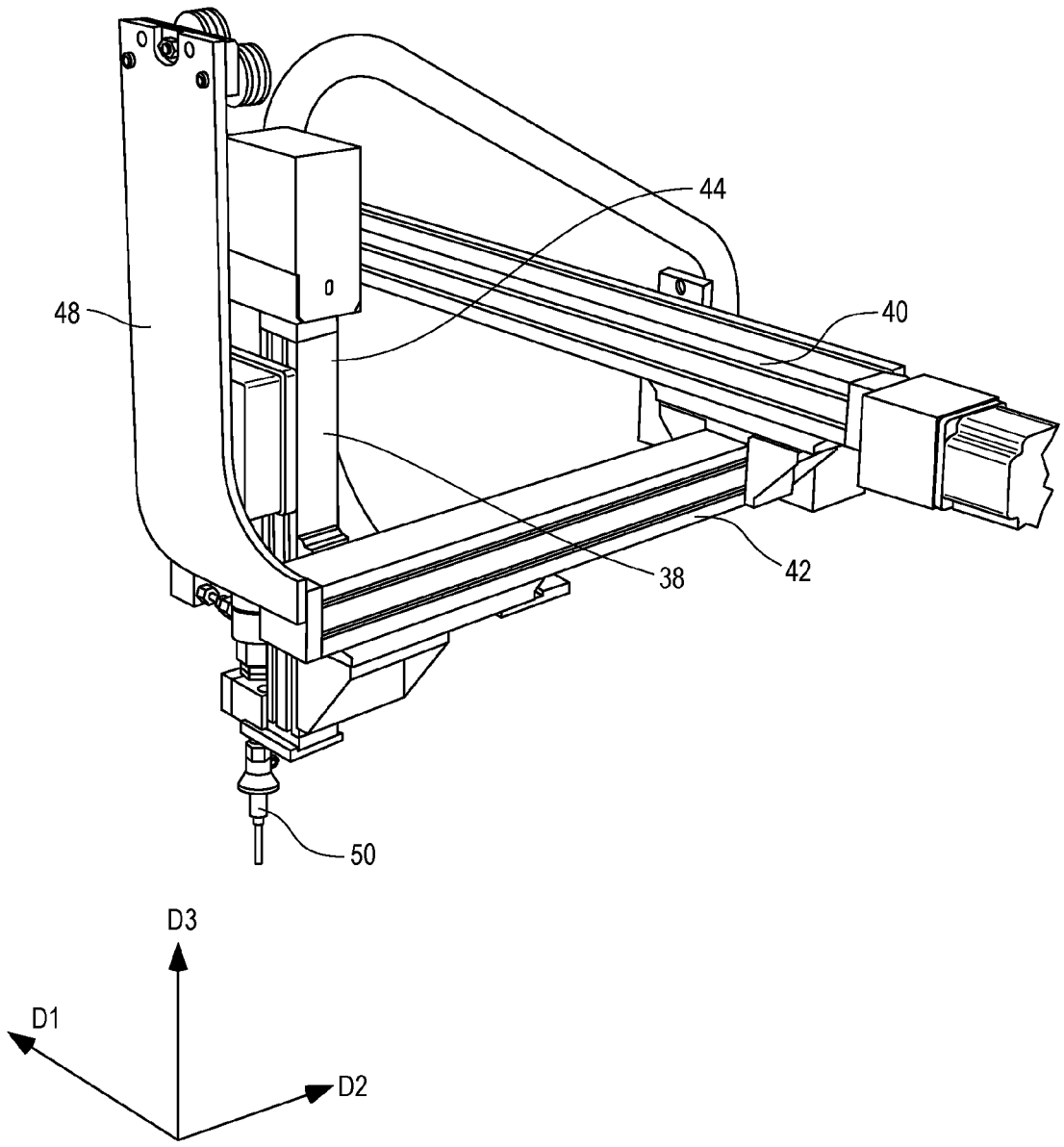
FIG. 9 is another perspective view of the guide assembly of FIG. 8.

FIG. 8 is a perspective view of a guide assembly 36 within the body 12 of the fluid jet cutting device 10 according to an embodiment described herein. FIG. 9 is an isolated perspective view of the guide assembly 36 of FIG. 8. Referring to FIGS. 8 and 9, the guide assembly 36 may be mounted within the body 12 and include one or more rails along which a cutting head 38 may move. In one embodiment, the guide assembly 36 includes a first rail 40 extending a first direction D1, a second rail 42 extending in a second direction D2 and a third rail 44 extending a third direction D3. The guide assembly 36 may further include a support rail 46. The support rail 46 may be spaced from the first rail 40 and extend in the first direction. In one embodiment, each of the first direction D1, second direction D2 and third direction D3 may extend perpendicularly relative to one another. As such, the first, second and third directions D1, D2, D3 may generally be shown as and correspond to x, y, z axes as understood in the art. It is understood that the first rail 40, second rail 42 and third rail 44 are not limited to the rail structures shown or described herein, and that other suitable structures are envisioned. For example, other slidingly mated structures may be used, including telescoping structures, tracks including one member slidable relative to another, or guide bars or supports on which a member may slide or roll.

Figure 10:
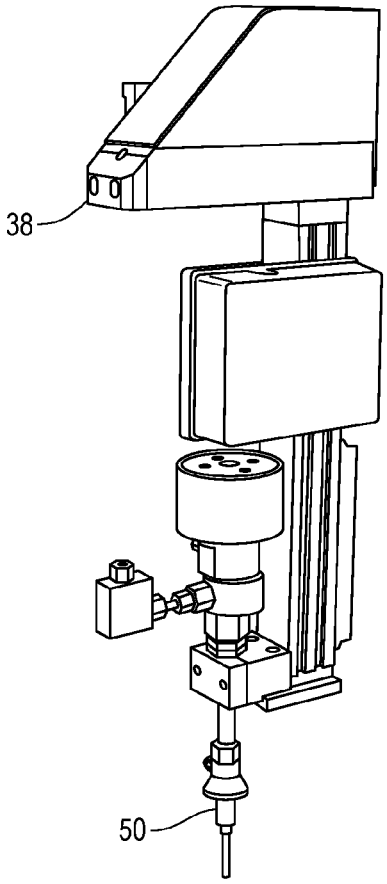
FIG. 10 is a perspective view of a cutting head of the fluid jet cutting device of FIG. 1 according to an embodiment described herein.
Figure 11:
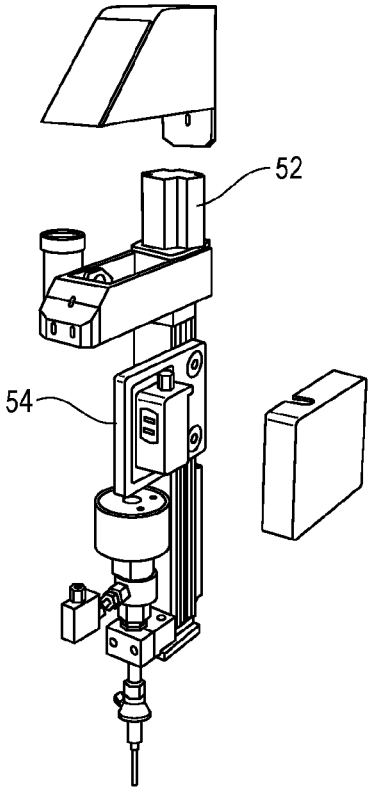
FIG. 11 is an exploded view of the cutting head of FIG. 9.

FIG. 10 is a perspective view of the cutting head 38 shown in FIGS. 8 and 9, according to the embodiments described herein. FIG. 11 is an exploded view of the cutting head 38 of FIG. 10. Referring to FIGS. 8-11, the cutting head 38 is movably coupled to the guide rail 46. In one embodiment, the cutting head 38 is movingly coupled to the guide rail 46 by way of one or more rollers or wheels. However, it is recognized that the present disclosure is not limited to such a configuration, and the cutting head 38 may be, for example, slidingly coupled to the guide rail 46. As shown in FIGS. 8 and 9, the cutting head 38 may be coupled to the guide rail 46 via a coupling plate 48.

The cutting head 38 is coupled to the second rail 42 for movement in the second direction D2. In one embodiment the cutting head 38 is slidingly coupled to the second rail 42, however, it is understood, that the cutting head 38, may be alternatively, for example, rollingly coupled to the second rail 42. The third rail 44 allows for movement of the cutting head 38, or a portion of the cutting head 38 on which a nozzle 50 is positioned, to move in the third direction D3. In one embodiment, the third rail 44 may be formed by first and second plates slidable relative another.

Referring to FIGS. 10 and 11, the cutting head 38 may include a drive assembly 52 for moving the cutting head 38 in at least one of the first, second and third directions D1, D2, D3. In one embodiment, the driving assembly 52 may include separate elements or mechanisms for driving the cutting head 38 in different directions. Alternatively, a single drive mechanism may be suitable for driving the cutting head 38 in different directions. The driving assembly 52 may include, for example, one or more motors, for example electric motors. Alternatively, or in addition, the driving assembly 52 may include a magnetic drive mechanism. In another embodiment, the drive assembly 52 may include one or more components, such as an arm or a lift, positioned remotely from the cutting head 38 but configured to act on or apply a force to the cutting head 38 to drive the cutting head 38 in one or more of the first, second or third directions D1, D2, D3.

With further reference to FIG. 11, the cutting head 38 may also include a height sensor 54. The height sensor 54 is configured to detect or sense a distance of the nozzle 50 or cutting head 38 from the work piece or sample. In response to, or based on, a detected distance from the work piece or sample, the cutting head 38 and nozzle 50 may be calibrated to cut the work piece accordingly.

The nozzle 50 may be secured to the cutting head 38. In one embodiment, the nozzle 50 is positioned in fluid communication with a fluid supply source (not shown) and is configured to receive the fluid from the fluid supply source. The fluid may be delivered to the nozzle 50 by way of the pump assembly 26. In addition, the nozzle 50 may also be in communication with the abrasive supply tank 30 so as to receive the abrasive material from the abrasive supply tank 30. Accordingly, the nozzle may discharge a jet of high-pressure fluid, or fluid and abrasive material to cut a work piece or sample in the working chamber 16.

Figure 12:
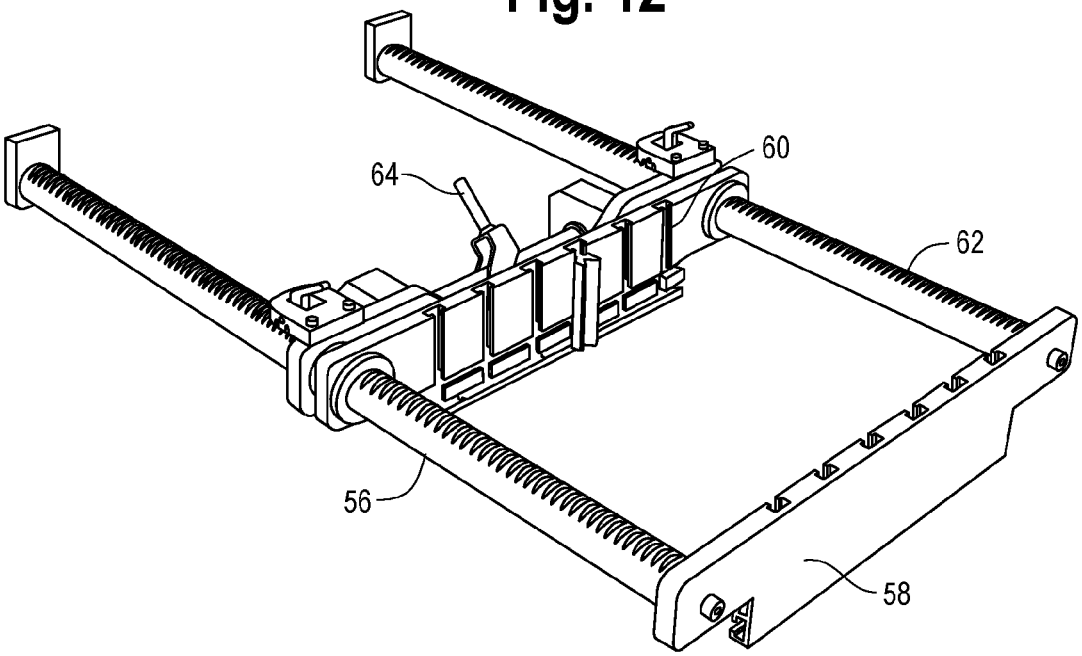
FIG. 12 is a perspective view of a clamp for holding a work piece in the fluid jet cutting device of FIG. 1, according to an embodiment described herein.
Figure 13:
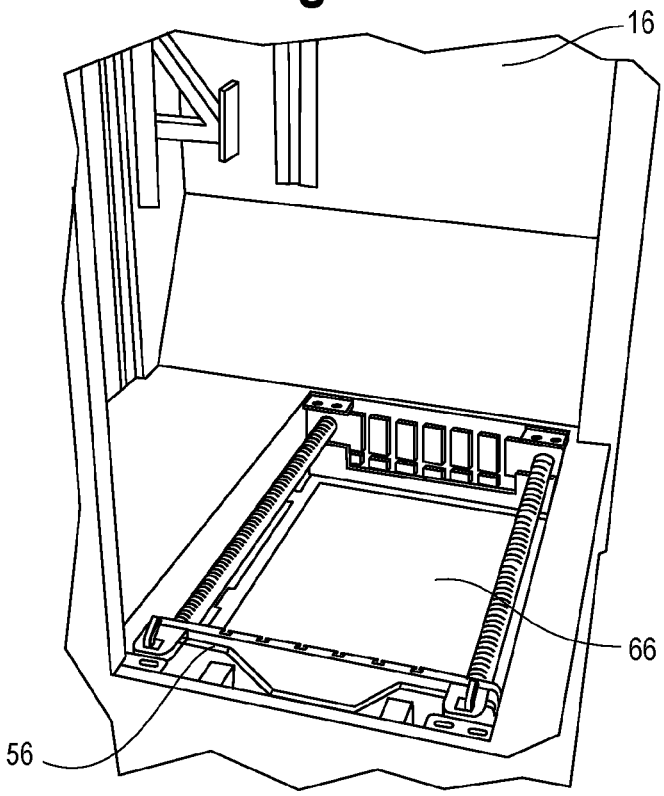
FIG. 13 is a perspective view of an interior of the fluid jet cutting device of FIG. 1 according to an embodiment described herein.

FIG. 12 is a perspective view of a clamp 56 for holding a work piece or sample in the working chamber 16. FIG. 13 is a perspective view of the clamp 56 positioned within the body 12 in the working chamber 16. Referring to FIGS. 12 and 13, in one embodiment, the clamp 56 include a first face or block 58 and a second face or block 60 with at least one of the first or second face 58, 60 movable toward and away from the other of the first or second face 58, 60 so as to clamp a work piece or sample therebetween. The first and/or second face 58, 60 may be movable along one or more guide bars 62. The first and/or second face 58, 60 may also include locking lever 64 to actuate lock to secure the respective first or second face 58, 60 in a desired position. The clamp 56 may be secured or fixed to the body 12. The first and second faces 58, 60 may also include slots allowing for attachments to be secured thereto to accommodate differently shaped objects or work pieces to be clamped between the faces 58, 60.

With reference to FIG. 13, a basket 66 is positioned in the receptacle 18 of the body 12 (see FIG. 3). In one embodiment, the basket 66 is submerged in the fluid in the receptacle, for example, up to approximately 12 inches below a surface of the fluid. However, this depth may vary. Thus, the basket 66 may be spaced from the clamp 56. The basket 66 may be formed as a mesh plate having a plurality of openings. The basket 66 may optionally be formed with upstanding sides (not shown). In one embodiment, the openings are sized so as to prevent specimens that have been cut from a work piece from falling to a bottom of the receptacle. That is, the mesh is configured so as to be able to catch specimens of suitable size for easy retrieval with removal of the basket 66. In one example, the openings do not exceed one inch in a transverse direction. With this configuration, the clamp 56 may be able to accommodate irregularly shaped objects that are not able to lie flat, or in a desired position for cutting, on or in the basket 66. In addition, because the basket 66 may be submerged in the fluid in the receptacle, energy from the fluid jet may be dissipated by the before contacting the basket 66, thus, the opening size may be made smaller.

Figure 14:
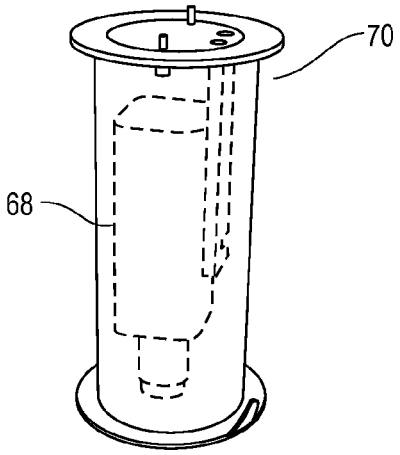
FIG. 14 is a perspective view of a camera of the fluid jet cutting device of FIG. 1, according to an embodiment described herein.
Figure 15:
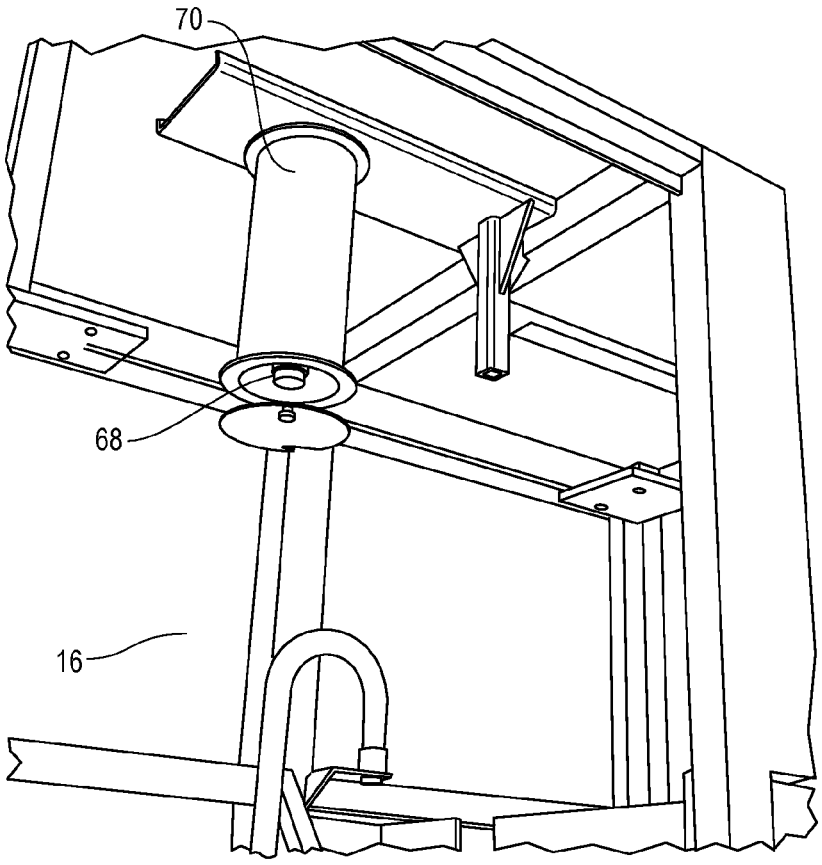
FIG. 15 is a perspective view of the camera of FIG. 14 installed in the fluid jet cutting device of FIG. 1 according to an embodiment described herein.

FIG. 14 is an isolated perspective view of a camera 68 adapted for use with the fluid jet cutting device 10 according to an embodiment described herein. FIG. 15 is a perspective view showing the camera 68 installed in the fluid jet cutting device 10, for example, in the working chamber 16. In one embodiment, the camera 68 is disposed within a camera housing 70 and positioned within body 12. The camera housing 70 may be waterproof. As shown in FIG. 15, in one embodiment, the camera 68 may be disposed in the working chamber 16. The camera is configured to capture, record and/or transmit images of the work piece within the working chamber 16.

Figure 16:
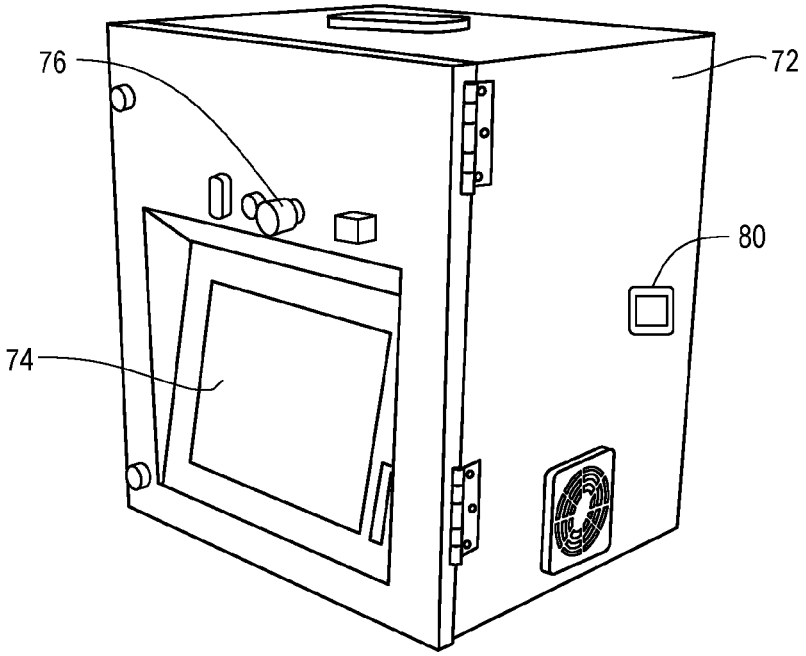
FIG. 16 is a perspective view of a user interface of the fluid jet cutting device of FIG. 1 according to an embodiment described herein.

As shown in FIG. 1, for example, the fluid jet cutting device 10 may also include a user interface 72. FIG. 16 is an isolated perspective view of the user interface 72. Referring to FIG. 16, the user interface 72 may include a display 74 and one or input devices 76. The input devices 76 may be, for example, switches or buttons for operating or turning the power on/off for the fluid jet cutting device 10, a key board, number pad, joy stick, pointer or the like. In addition, or alternatively, the input device 76 may include an input/output (I/O) port to which peripheral input devices (not shown) may be connected. Further, the input device 76 may be combined with the display 74 in the form of a touch screen display.

Figure 17:
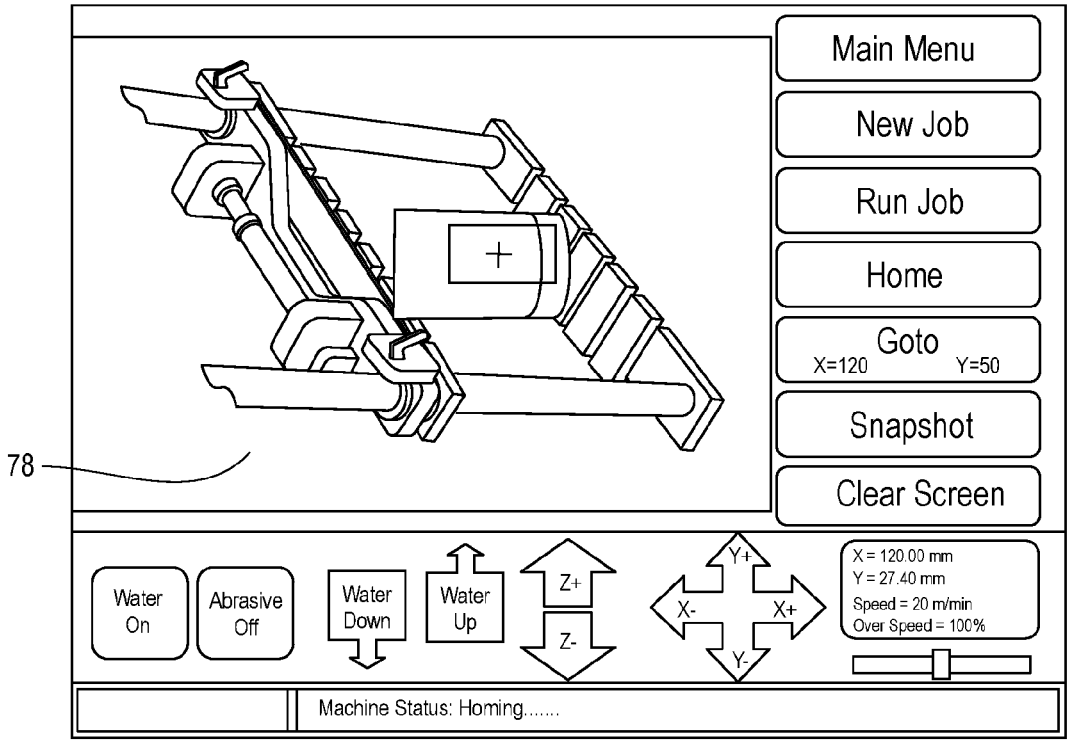
FIG. 17 is an example of a graphical user interface for display on the fluid jet cutting device of FIG. 1.

FIG. 17 is an example of a graphical user interface 78 to be displayed on the display 74. The graphical user interface 78 may include a menu with items which may be selected by an operator using the input device or devices 76. In one embodiment, the user interface 72 is operatively and/or communicatively connected to the camera 68 so as to display an image that has been captured, recorded or transmitted by the camera 68 on the display 74. The image from the camera 68 may be displayed in the graphical user interface 78 together with one or menus. The menus may include, for example, operational instructions to control the cutting head 38 and/or nozzle 50, or operating parameters thereof. Operating parameters may include, for example, position and velocity of the cutting head 38, and velocity or flow rate of the fluid jet discharged from nozzle 50. It is understood that these parameters are only examples, and are not exhaustive. The menus of the graphical user interface 78 may also include options for navigating the graphical user interface 78, for example, through different menus and sub-menus.

The fluid jet cutting device 10 may also include a controller 80 (shown schematically in FIG. 16). The controller 80 may be operatively and/or communicatively connected to, for example, the user interface 72, the camera 68, the cutting head 38 including the height sensor 54, the nozzle 50, the drive assembly 52, the pump assembly 26, the motor 28 and/or the abrasive supply tank 30.

The controller 80 may be implemented as a microprocessor or computer having a microprocessor configured to execute program instructions stored in one or more computer-readable storage media, such as, but not limited to, a memory unit. Computer-readable storage media include non-transitory media, for example, magnetic media, including hard disks and floppy disks; optical media including CD ROM disks and DVDs, and/or optical disks. Computer-readable storage media may also include hardware devices configured to store and/or perform program instructions, including read-only memory (ROM), random access memory (RAM), flash memory and the like. It is understood that non-transitory media does not include signals or waves. The memory unit may be part of the controller 80, or a separate unit that is operably and communicatively connected to the controller 80.

In the embodiments above, the camera 68 may be used to display the work piece on the display 74. Through the user interface 72, an operator may overlay a shape or cutting pattern on the displayed work piece image. The shape or pattern may be a predetermined shape or pattern selected by the operator, or may be custom input from the operator. The controller 80 may execute software stored at the device 10 to translate the overlaid cutting shape or pattern (cutting path) into machine movement (i.e., movement of the cutting head 38), and time the water and optionally the abrasive flow to cut the work piece at a desired rate. Because the operator may input a cutting path at the user interface, it may not be necessary to import additional information from a CAD software program, although such functionality remains in the device described herein.

Further, in the embodiments above, the cut made by the cutting head 38, and in particular, by the high-pressure fluid jet discharged from the nozzle 50 on the cutting head 38, may compensate for changing heights. In the embodiments described herein, the height sensor 54 measures a distance between, for example, the work piece and the nozzle 50. The height sensor 54 may be a capacitive sensor. Accordingly, the cutting head 38, in response to the measured data from the height sensors, and control signals received from the controller 80, may auto-compensate to components with varying height without additional operator programming.

In the embodiments above, a compact fluid jet cutting device is provided that is sized and dimensioned for use in non-factory or non-production facilities such as a laboratory or classroom. In one embodiment, the device may be sized so as to fit through standard sized double doors. In the embodiments above, a work piece may be cut through two planes without adjusting or repositioning the work piece in the clamp in the working chamber. In addition, the clamp may hold and the device above may cut specimens from regular, irregular and complex shapes. The device may cut materials with a hardness of, for example 80 HRC at a rate of greater than 0.1 inch/minute for a 6 inch sample, or 0.5 inch/minute for a 1 inch sample. The working chamber is compact and enclosed. The device described herein may have a footprint of, for example, 15 sq. ft. The user interface described herein may be used by operators other than trained machinists or those with CAD design abilities.

Further, in the embodiments above, the basket 66 may be submerged in a fluid stored in the receptacle 18. The basket 66 may be formed with openings of a small size so as to be able to catch and retain small sample pieces or specimens cut from the work piece. The basket 66 may be submerged so that energy from the fluid jet is dissipated by the fluid rather than the basket 66. Thus, the basket 66 is not subjected to direct forces from the fluid jet and may be reused and have a longer service life than conventional slats or baskets. Conventional slats or baskets typically support a work piece directly thereon and require larger openings to allow the fluid jet to pass therethrough. In addition, the conventional slats or baskets are designed to be disposable as the portions that are contacted directly by the fluid jet may be cut away or damaged by the fluid jet.

In the embodiments above, the fluid jet cutting device 10 the pump assembly, motor and/or abrasive supply tank may be mounted and secured to a common base for simultaneous installation and removal from the equipment chamber. Accordingly, these components may be made modular for quicker and more convenient installation, removal and repair from the body.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A fluid jet cutting device for sectioning materials for analytical sample preparation, the fluid jet cutting device comprising:

a body having an equipment chamber accessible through a first panel, a working chamber accessible through a second panel and a receptacle in communication with the working chamber;

a pump assembly positioned in the equipment chamber;

a motor positioned in the equipment chamber, the motor configured to drive the pump assembly;

a guide assembly positioned in the working chamber;

a cutter head assembly having a nozzle for discharging a fluid jet movably coupled to the guide assembly for movement along three axes;

a drive assembly for moving the cutter head along the guide assembly;

a clamp for holding a work piece in the working chamber, the clamp comprising a first face and a second face movable relative to the first face to secure the work piece therebetween; and a basket positioned in the receptacle beneath the clamp.

2. The fluid jet cutting device of claim 1, further comprising a base removably positioned in the equipment chamber, wherein the pump assembly and motor are mounted on the base and are removable from the equipment chamber with the base.

3. The fluid jet cutting device of claim 2, further comprising an abrasive supply tank positioned in the equipment chamber and mounted on the base and is removable from the equipment chamber with the base.

4. The fluid jet cutting device of claim 1, further comprising an abrasive supply tank positioned in the equipment chamber.

5. The fluid jet cutting device of claim 1, wherein the guide assembly includes a first rail extending in a first direction, a second rail extending a section direction and third rail extending a third direction.

6. The fluid jet cutting device of claim 5, further comprising a support rail, spaced from the first rail, extending in the first direction.

7. The fluid jet cutting device of claim 6, wherein the each of the first direction, the second direction and third direction extends perpendicularly to one another.

8. The fluid jet cutting device of claim 5, wherein the cutting head is coupled to the first rail.

9. The fluid jet cutting device of claim 8, wherein the third rail is on the cutting head.

10. The fluid jet cutting device of claim 9, wherein the drive assembly is positioned on the cutting head.

11. The fluid jet cutting device of claim 1, wherein the first face and second face of the clamp are positioned on one or more guide bars, and at least one of the first face and the second face is movable along the one or more guide bars toward and away from the other of the first face and the second face.

12. The fluid jet cutting device of claim 1, wherein the basket includes a mesh layer for allowing fluid communication between the working chamber and the receptacle.

13. The fluid jet cutting device of claim 12, wherein openings formed in the mesh layer are less than one inch.

14. The fluid jet cutting device of claim 1, wherein the first panel is a first door pivotably mounted on the body.

15. The fluid jet cutting device of claim 1, wherein the second panel includes one or more second doors pivotably mounted to the body to selectively allow and restrict access to the working chamber.

16. The fluid jet cutting device of claim 15, wherein the one or more second doors include a transparent panel so that the working chamber is visible through the transparent panel from a position outside of the working chamber with the one or more second doors in a closed position so as to restrict access to the working chamber.

17. The fluid jet cutting device of claim 1 further comprising a user interface having a display and an input device.

18. The fluid jet cutting device of claim 17, further comprising a controller communicatively connected to the user interface, the drive mechanism and the cutter head assembly, wherein the controller controls operation of the drive mechanism and/or the cutter head assembly in response to input received from the input device of the user interface.

19. The fluid jet cutting device of claim 18, further comprising a camera configured to record images of the work piece within the working chamber, wherein the recorded image is displayed on the display of the user interface.

20. The fluid jet cutting device of claim 19, wherein input device is a screen on the display, and the display is a touch screen display.

21. The fluid jet cutting device of claim 1, wherein input received at the user interface is received by the controller to control the drive mechanism and movement of the cutting head.

22. The fluid jet cutting device of claim 1, further comprising a camera configured to record images of the work piece within the working chamber.

* * * * *